United States Patent [19]

Francis

[11] 4,168,571

[45] Sep. 25, 1979

[54] SHAVING UNIT

[75] Inventor: John F. Francis, Woking, England

[73] Assignee: The Gillette Company, Boston, Mass.

[21] Appl. No.: 873,062

[22] Filed: Jan. 27, 1978

[30] Foreign Application Priority Data

Feb. 2, 1977 [GB] United Kingdom ..... 4330/77

[51] Int. Cl.[2] ..... B26B 21/22

[52] U.S. Cl. ..... 30/47; 30/50; 30/346.58

[58] Field of Search ..... 30/32, 47, 50, 52, 304, 30/305, 342, 346.58, 346.59, 77, 81, 83

[56] References Cited

U.S. PATENT DOCUMENTS

| | | | |
|---|---|---|---|
| 1,599,482 | 9/1926 | Moore | 30/81 |
| 1,935,452 | 11/1933 | Kondolf | 30/73 |
| 2,107,358 | 2/1938 | Aghito | 30/44 |
| 2,313,818 | 3/1943 | Gaisman | 30/346.53 |
| 2,327,967 | 8/1943 | Peters | 30/77 |
| 2,915,817 | 12/1959 | Peck | 30/48 |
| 3,500,539 | 3/1970 | Muros | 30/40.1 |
| 3,657,810 | 4/1972 | Nissen | 30/63 |
| 3,660,893 | 5/1972 | Welsh | 30/50 |
| 3,685,150 | 8/1972 | Risher | 30/74.1 |
| 3,740,841 | 6/1973 | Risher | 30/32 |
| 3,940,853 | 2/1976 | Francis | 30/50 X |
| 4,069,580 | 1/1978 | Cartwright | 30/47 |
| 4,083,104 | 4/1978 | Nissen | 30/47 |
| 4,084,316 | 4/1978 | Francis | 30/50 X |

FOREIGN PATENT DOCUMENTS

| | | | |
|---|---|---|---|
| 2447087 | 4/1975 | Fed. Rep. of Germany | 30/52 |
| 510560 | 8/1939 | United Kingdom . | |

*Primary Examiner*—Gary L. Smith

*Attorney, Agent, or Firm*—Richard A. Wise; Scott R. Foster

[57] ABSTRACT

A shaving unit comprising a frame, a blade member supported by the frame, first and second skin engaging elements supported by the frame and disposed respectively, in use of the unit, forwardly and rearwardly of the blade member, the first and second skin engaging elements being mounted in the frame in a manner permitting their resilient displacement relative to the frame and the blade member.

8 Claims, 9 Drawing Figures

SHAVING UNIT

BACKGROUND OF THE INVENTION

1. Field of the Invention

This invention relates to shaving units and is directed more particularly to shaving units of the type in which portions thereof are movable during a shaving operation to effect dynamic changes in the shaving geometry of the unit.

2. Description of the Prior Art

In some known shaving units, the shaving geometry, i.e., the spatial relationships between the blade and rigid portions of the razor head are fixed. U.S. Pat. No. 3,786,563, issued Jan. 22, 1974 to Francis W. Dorion, et al is illustrative of this type of razor unit, and is further illustrative of the spatial relationships deemed pertinent.

In a second known category of shaving units, the shaving geometry is adjustable in that one or more of the portions of the unit may be re-positioned relative to the others, by the user, and remain in their new positions until selectively re-adjusted. U.S. patent application Ser. No. 432,842, filed Jan. 4, 1974 by Chester F. Jacobson is illustrative of such a unit.

It has also been proposed to construct a shaving system with a cap member fixed relative to a handle and with blade and guard members made fast with each other and spring biased to a position of maximum blade exposure, the blade and guard members being adapted to retract against the spring bias upon encountering undue resistance during shaving. An arrangement of this sort is described in U.S. Pat. No. 4,063,354, issued Dec. 20, 1977 to Harry Pentney et al.

Several arrangements of shaving units permitting dynamic movement of various portions thereof during a shaving operation have been devised; examples of such contrivances are illustrated in U.S. Pat. Nos. 1,935,452 issued Nov. 14, 1933 to M. R. Kondolf; 2,313,818 issued Mar. 16, 1943 to H. J. Gaisman; 2,327,967, issued Aug. 24, 1943 to P. N. Peters; 2,915,817 issued Dec. 8, 1959 to E. Peck; 3,500,539, issued Mar. 17, 1970 to J. P. Muros; 3,657,810 issued Apr. 25, 1972 to W. I. Nissen; 3,685,150 issued Aug. 22, 1972 to F. L. Risher; and 3,740,841 issued June 26, 1973 to F. L. Risher.

SUMMARY OF THE INVENTION

An object of the present invention is to provide a shaving unit permitting close conformity to a skin surface during a shaving operation.

A further object is to provide such a unit in which first and second skin engaging elements disposed forwardly and rearwardly, respectively, of the blade means are so mounted in a frame as to permit their resilient displacement relative to the frame and the blade means.

A still further object is to provide such a unit in which the blade means is resiliently mounted in the frame, whereby to permit individual movement of each blade member of said blade means.

With the above and other objects in view, as will hereinafter appear, a feature of the present invention is the provision of a shaving unit comprising a frame, blade means supported by the frame, first and second skin engaging elements supported by the frame and disposed respectively, in use of the unit, forwardly and rearwardly of the blade means, the first and second skin engaging elements being mounted in the frame in a manner permitting their resilient displacement relative to the frame and the blade means.

In accordance with a further feature of the invention, there is provided a shaving unit as above described in which said blade means are resiliently mounted in the frame in a manner permitting individual movement of each blade of said blade means.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

Figure 1:
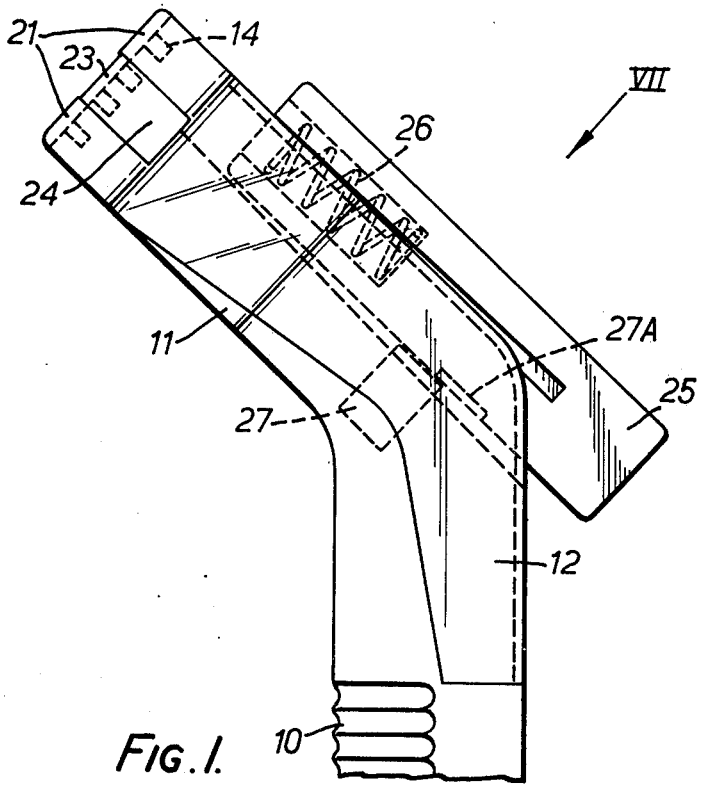
FIG. 1 is a side view of one razor.
Figure 2:
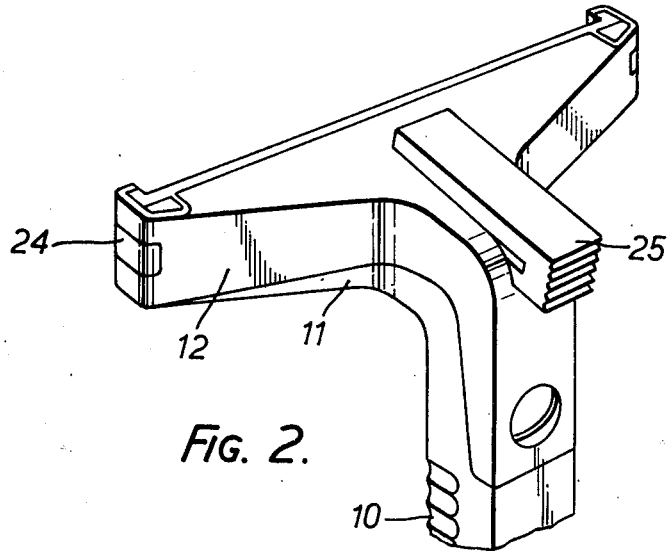
FIG. 2 is a rear perspective view of the same razor.
Figure 3:
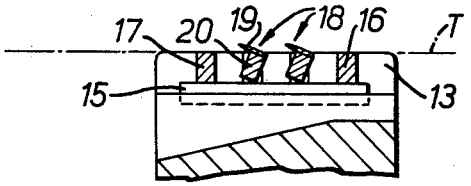
FIG. 3 is a cross-section on the line III—III in FIG. 7.
Figure 4:
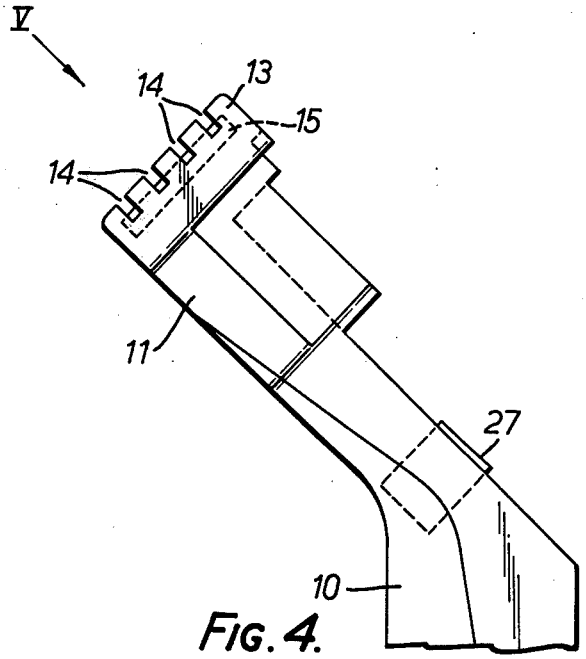
FIG. 4 is a scrap side view of a handle and frame portion of the razor.
Figure 5:
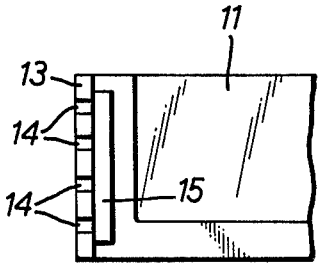
FIG. 5 is a view on arrow V in FIG. 4.
Figure 6:
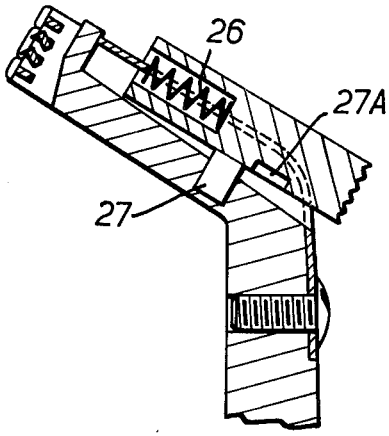
FIG. 6 is a cross-section of the razor.

The razor shown in FIGS. 1 to 7 comprises a molded handle 10 having at its upper end an integral frame portion 11 extending transversely of the handle and a metal capping member 12 applied to the rear side of the handle and embracing the ends of the frame portion 11.

The ends of the frame portion are formed with upstanding end walls 13 each formed with four parallel slots 14, open at their outer ends. Mounted in pockets at the foot of each end wall are elastomeric pads 15, which may be solid or in the form of tubes.

The cap member 16 and guard member 17 of the razor are formed as slender metal bars whose ends are received in respective slots 14 and the tandem cutting edges of the razor are provided by two blade members 18 each comprising a thin, narrow blade strip 19 and a wire-like metal support 20 of rectangular cross-section having the blade strip secured, as by projection welding, to its flat upper face. The end portions of the supports are twisted and set at an angle of about 22° to the medial portions of the supports, so as to set the blade strips at 22° to the notional tangent plane T drawn through the skin engaging surfaces of the cap and guard members. The overall width of the frame portion 11 in this embodiment is 7.5 mm, the width of the blade strips is 1 mm, the width of the supports 20 is 0.5 mm and the depth of the supports is 1.00 mm.

The end portions of the cap and guard members and blade supports bear at their lower surfaces against the elastomeric pads 15. The cap and guard members are restrained against moving out of their slots by inturned flanges 21 of the capping member 12, and the ends of the blade supports by corresponding flanges 23 on respective catches 34 which are mounted between the frame portion and the capping member for pivotal movement under the control of a slide 25.

Figure 7:
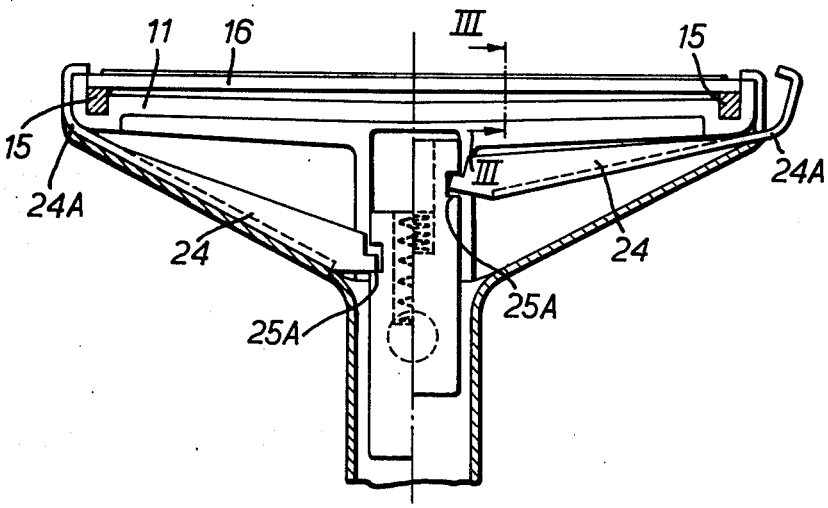
FIG. 7 is a view taken in the direction of arrow VII in FIG. 1.

In FIG. 7, the capping member 12 is broken away for clarity and the left hand half of the Figure shows the slide in its normal, rear position, while the right hand half shows the slide in its forward position. From this Figure, it can be seen that the catches 24 pivot about fulcrums formed by engagememt of elbow portions 24A with the adjacent ends of frame portion 11.

The sides of the slide 25 are grooved for sliding engagement in a slot formed in the capping member 12. The slide is formed with a pocket to house a light compression spring 26, whose forward end abuts the end edge of the above mentioned slot in the capping member and which biasses the slide rearwardly to the position shown in FIGS. 1 and 2 and the left hand half of FIG. 7. The slide can be moved forwardly by finger pressure to ride over a pin 27 carried by the frame member 11. At the most forward position of the slide, the pin engages in a recess 27A in the slide to retain the slide in that position, which is shown in the right hand half of FIG. 7.

The slide has notches 25A in its sides to engage lugs on the respective catch members 24. As best seen in FIG. 7, when the slide 25 is in its normal, rear position, the catches 24 are positioned to retain the blade members in their slots. Forward movement of the slide causes the outer ends of the catches to swing outwardly, as shown in the right hand half of FIG. 7, thereby releasing the blade members for removal from their slots 14. As explained above, engagement of the pin 27 in recess 27A holds the slide in its forward position and thus facilitates the loading of fresh blade members into the slots 14. The user then exerts a light upward pressure on the rear end of the slide 25 to disengage it from pin 27, whereupon the spring 26 returns the slide to its rear position and the catches 24 to their normal positions.

In the assembled razor, the cap and guard members and the blade members all have a limited degree of permitted movement up and down their respective slots, i.e. in directions perpendicular to the notional tangent plane T. These members are all biassed outwardly by a slight pre-load in the pads 15, but are able to move inwardly against the bias of the pads by pressures encountered during shaving. The parts may all be subjected to an equal initial bias but this can be varied from one part to another by suitable dimensioning of the parts and/or shaping of the pads 15. Since the ends of the parts are independently supported by the pads, the parts are not only capable of bodily movement along the slots, but also of rocking movement by differential displacement of their respective ends.

This independent "floating" action of the parts permits greater degrees of conformability to facial contours than the known razors mentioned above, and early trails indicate that efficacy of the tandem shaving edges tends to be increased. The very narrow head of the present embodiment also facilitates efficient shaving of facial declivities such as the areas immediately beneath the nose, and between the lower lip and chin.

The cap, guard and blades do not necessarily have to be constrained for parallel movement, nor does the movement have to be perpendicular to the tangent plane, these and many other variations being possible within the scope of the present invention.

Other non-illustrated modifications include the provision of a guard member comprising a pair of parallel wires, the forward guard wire being set slightly below the rear guard wire. Also, it may be possible to obtain a satisfactory shave with the cap member omitted completely or substituted by a third blade.

Figure 8:
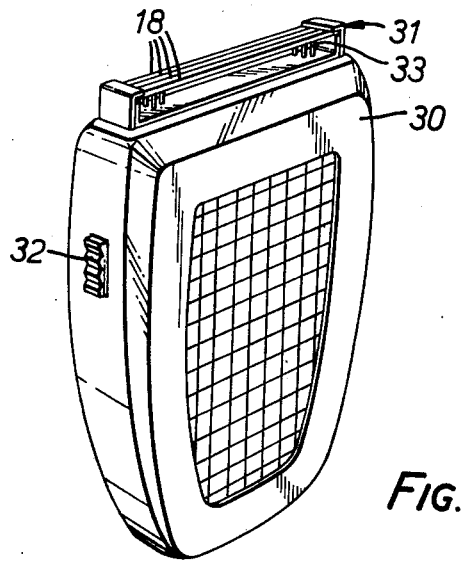
FIG. 8 is a perspective view of a second form of razor in accordance with the invention.
Figure 9:
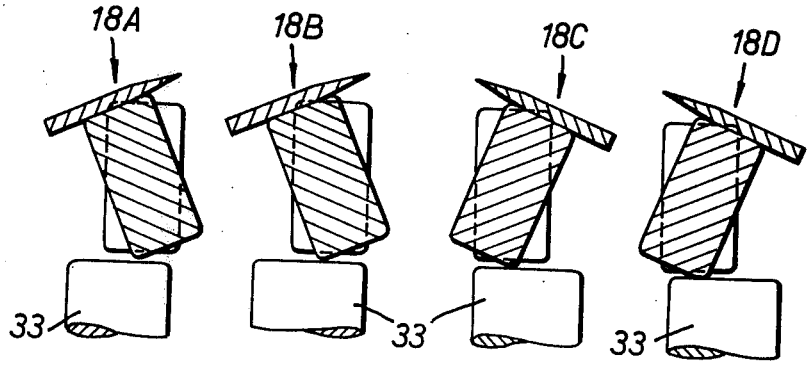
FIG. 9 is a cross-section, corresponding with FIG. 3, of the skin engaging members of the razor shown in FIG. 8.

The razor shown in FIGS. 8 and 9 is of the so-called "block" type, comprising a casing 30 of a size and shape to be gripped in the palm of the hand in the manner of a conventional electric razor. The razor may have an array of skin engaging elements like that of the above described razor but preferably, and as shown, consists of two oppositely directed pairs of blade members 18A, 18B and 18C, 18D, spaced apart from each other, the cutting edges of each pair being parallel with each other and offset so as to act in tandem upon the skin of the user. This arrangement of blades is designed to permit the user to shave with a to-and-fro scrubbing action. In one direction of movement, two blade members, e.g. 18A, 18B, are acting as blades, while the other pair 18C, 18D have their cutting edges turned away from the direction of movement and act as skin engaging guard members. The trailing blade 18A acts not only as a cutting member, but also carries out the function of a cap member relative to the leading blade 18B.

Since all four skin engaging elements are blades, they will usually be replaced as a set when their cutting edges become dulled and are conveniently mounted in a removable frame member 31 which is discarded and replaced as a whole. The frame member 31 conveniently makes snap-fitting engagement with the casing and can be released by operation of push button catches 32 at the sides of the casing 30.

The frame member 31 may carry elastomeric pads like the pads 15 described above, or resilient means may be mounted in the casing to act upwardly on the blade members through push rods 33 as shown in FIGS. 8 and 9.

The blade members shown are identical with those shown at 18 in the first embodiment and by way of example, the spacing of the innermost cutting edges (i.e. of units 18B and 18C) may be 0.75 mm, each trailing blade having its cutting edge set 1.25 mm rearwardly of the leading edge of the pair.

Other combinations of the skin engaging members will be possible. Also, while the illustrated embodiments show the preferred arrangement in which each member is individually sprung and movable relative to the others, it would be possible to arrange for one or more members to be fixed and/or for members to be fast with each other for movement together in groups, such as the pair of blade members, and/or the cap and guard members in FIG. 3.

Having thus described my invention what I claim as new and desire to secure by Letters Patent of the United States is:

1. A safety razor comprising a frame, resilient mounting means fixed to said frame, blade means disposed on said mounting means, first and second skin engaging elements disposed on said mounting means and adapted in operation to engage a surface being shaved ahead and rearwardly, respectively, of said blade means, said first and second elements being movable with said resilient mounting means relative to said frame, and said blade means being movable with said resilient mounting means independently of movement of said first and second elements in a direction transverse to a tangent plane defined by exposed edges of said first and second elements.

2. A safety razor comprising a handle, a frame connected to said handle, a guard member resiliently mounted on said frame, a cap member resiliently mounted on said frame, and at least one blade member resiliently mounted on said frame between the cap and guard members, each of said guard, cap and blade members being individually movable relative to the other of said members, in directions transverse to a tangent plane defined by skin engaging surfaces of the cap and guard members.

3. A razor according to claim 2, wherein said members are each mounted by their opposite ends in slots in the frame, the slots being elongated in the direction of movement of the members, and resilient means act on the individual ends of the respective members to bias them in an outward direction.

4. A razor according to claim 3, in which members of elastomeric material located at opposite ends of the frame constitute said resilient means.

5. A razor according to claim 3 or 4, wherein the said blade member comprises a narrow blade strip sharpened along one longitudinal edge and having one surface attached to an elongate support member whose ends project beyond the ends of the blade strip and are received in said slots in the frame.

6. A razor according to claim 5, wherein said blade member is removably mounted in the frame for disposal and replacement when its cutting edge becomes dulled.

7. A razor according to claim 6, wherein the ends of said blade member are retained in said slots by stops which are movable to permit removal of the blade member from the frame.

8. A razor according to claim 7, wherein said stops are formed at ends of catches mounted on the frame for movement in unison towards and away from each other.

* * * * *